US009332811B2

(12) United States Patent
Anderson et al.

(10) Patent No.: US 9,332,811 B2
(45) Date of Patent: May 10, 2016

(54) WEBBING BUCKLE WITH RELEASE MECHANISM

(75) Inventors: Jeffrey D. Anderson, Glenview, IL (US); Michael B. Grimm, Glenview, IL (US); Brian M. Parisi, Glenview, IL (US); Martin J. Nilsen, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 240 days.

(21) Appl. No.: 14/118,419

(22) PCT Filed: May 17, 2012

(86) PCT No.: PCT/US2012/038261

§ 371 (c)(1), (2), (4) Date: Nov. 18, 2013

(87) PCT Pub. No.: WO2012/158869

PCT Pub. Date: Nov. 22, 2012

(65) Prior Publication Data

US 2014/0173859 A1 Jun. 26, 2014

Related U.S. Application Data

(60) Provisional application No. 61/487,522, filed on May 18, 2011.

(51) Int. Cl.
*A44B 11/25* (2006.01)
*A44B 11/26* (2006.01)

(52) U.S. Cl.
CPC ..... *A44B 11/2592* (2013.01); *A44B 11/266* (2013.01); *A41D 2400/44* (2013.01); *A44B 11/2519* (2013.01); *Y10T 24/45272* (2015.01)

(58) Field of Classification Search
CPC ..... A44B 11/2591; A44B 11/266; A44B 11/2519; Y10T 24/45272
See application file for complete search history.

(56) References Cited

U.S. PATENT DOCUMENTS

| | | | | |
|---|---|---|---|---|
| 2,896,288 | A | 7/1959 | Davis | |
| 3,188,707 | A | 6/1965 | Schmidt | |
| 4,468,843 | A | 9/1984 | Duclos et al. | |
| 4,752,263 | A | 6/1988 | Pritchard et al. | |
| 4,831,694 | A | 5/1989 | Kong | |
| 5,531,622 | A | 7/1996 | Nealy | |
| 5,794,316 | A * | 8/1998 | Anscher | 24/625 |
| 6,487,761 | B2 | 12/2002 | Van Tassel | |
| 6,606,770 | B1 * | 8/2003 | Badrenas Buscart | 24/625 |
| 6,637,083 | B1 | 10/2003 | Howell | |
| 6,931,695 | B2 * | 8/2005 | Anscher | 24/614 |

(Continued)

OTHER PUBLICATIONS

ISR and WO for PCT/US2012/038261 mailed Aug. 20, 2012.

*Primary Examiner* — Robert J Sandy

(57) ABSTRACT

A buckle assembly includes a hollow buckle body and an insertable buckle latch with elongate latching legs. A separate reciprocable slide element carried by the buckle latch element with cam surfaces, angled relative to the longitudinal axis of the buckle that overlies the free ends of the latching legs. The cam surfaces are associated with angled surfaces on the latching legs forward of the latching edges. Movement of the slide element relative to the latch element causes the cam surfaces to urge the free ends of the latching legs together to unlatch the latching legs from the hollow buckle body locking edges. In one form, a cable is connected to the separate slide element to slide the separate slide element.

15 Claims, 4 Drawing Sheets

(56) References Cited * cited by examiner

U.S. PATENT DOCUMENTS

| | | | | |
|---|---|---|---|---|
| 7,600,302 | B2 * | 10/2009 | Dillner | 24/615 |
| 2005/0132545 | A1 | 6/2005 | Anscher | |
| 2011/0099776 | A1 * | 5/2011 | Anscher | 24/629 |

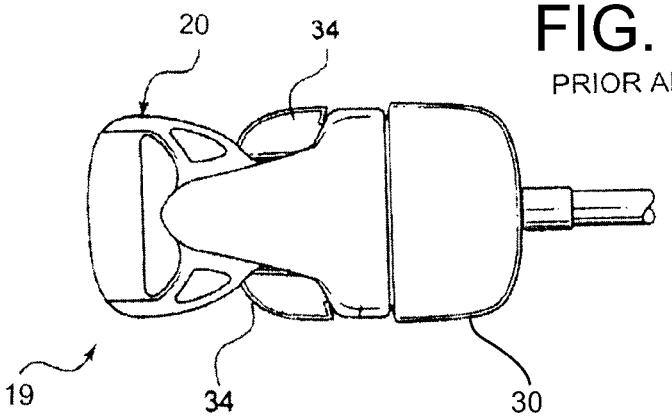
FIG. 1
PRIOR ART
FIG. 2
PRIOR ART
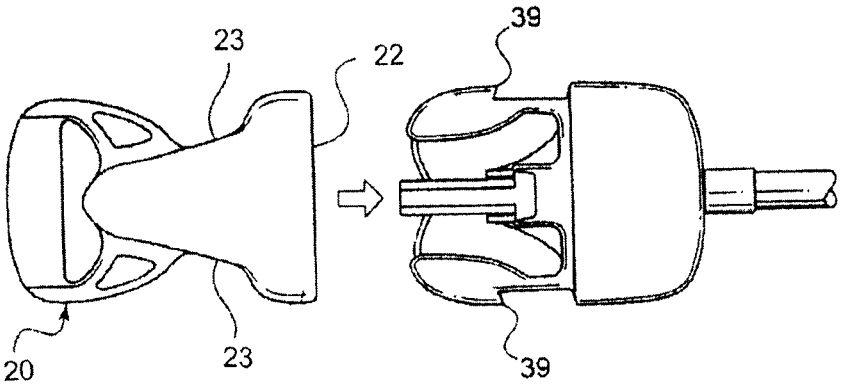
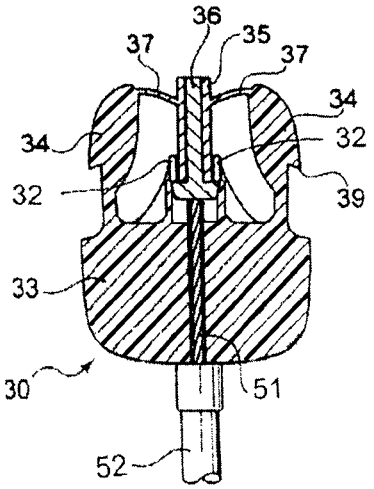
FIG. 3
PRIOR ART
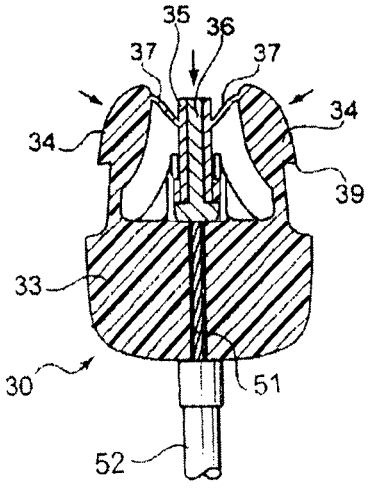
FIG. 4
PRIOR ART

WEBBING BUCKLE WITH RELEASE MECHANISM

CROSS-REFERENCE TO RELATED APPLICATION

This non-provisional application claims the benefit of, and priority from U.S. Provisional Application 61/487,522 filed May 18, 2011, the contents of which is incorporated by reference herein in its entirety.

BACKGROUND

This disclosure relates to buckles for connecting webbing. More particularly it relates to such buckles having a slide release actuation capability.

Releasable buckles are a mainstay in numerous harness or webbing securement applications. They are widely used in personal equipment such as clothing, back packs, vehicular restraint systems, parachutes, protective vests for military or law enforcement use and other applications. In some instances remote release of the connected buckle components is an important, often critical, feature.

One common form of buckle is the side release buckle. Made of polymeric material, it includes two engageable elements, a main buckle element or latch and a hollow buckle body which includes a pair of latching edges formed adjacent side openings in the body. Each element normally includes attachment loops to connect to associated harness or webbing. The latch element includes deformable latching legs that releasably engage the latching edges of the hollow buckle body. Manual deformation of the latching legs laterally toward each other at the side openings releases the legs from engagement with the latching edges on the hollow buckle body and the buckle elements are separable.

Side release buckles are suitable for remote actuation. A known application involves, for example, a military or police vest with multiple buckles connected for simultaneous remote release. Such side release buckles utilize a tension cord or cable actuator which operates to release the connected buckle components. An example can be found in application for U.S. patent application Ser. No. 12/459,398, published Dec. 16, 2010, as Publication No. 2010/0313392.

In the known remote release configuration the latching legs of the latch element are connected by a central, deformable web. The web is connected to a remotely operable tension cord that exerts a deforming force on the web. The free ends of the latching legs are pulled together transversely causing release of the latching legs of the latch element from the latching edges on the hollow body. The hollow buckle body also includes side openings to provide manual access to the deformable legs of the latch element.

As described, current systems use a one-piece latch design that relies on the plastic deformation of a tie-together strip between the latching legs within the buckle. Given the added material for the tension cord interface, resistance of the connected deformable web, and application angle, additional applied force is required to accomplish release when the secondary release is actuated.

SUMMARY OF DISCLOSURE

Described herein is a novel and innovative system to solve the problems with today's current remote release systems. The present disclosure presents an arrangement of a buckle having a secondary or remote release mechanism that eliminates reliance on the deformation of a tie-together strip of latch element material. It includes a separate reciprocable slide element carried by the buckle latch element with cam surfaces, angled relative to the longitudinal axis of the buckle. The reciprocable slide element is a hollow body that overlies the free ends of the latching arms of the latch element. The cam surfaces are associated with angled surfaces on the latching legs forward of the latching edges. Movement of the slide element relative to the latch element causes the cam surfaces to urge the free ends of the latching legs together. This action unlatches the latching legs from the hollow buckle body latching edges and permits separation of the buckle elements. In this arrangement, the resistive force to be overcome, lateral deformation of the latching legs, remains the same, regardless of the manner of actuation.

DESCRIPTION OF THE DRAWINGS

FIG. 1 is a top view of a prior art remote release buckle assembly with buckle components latched;

FIG. 2 is a top view of the prior art, remote release buckle assembly of FIG. 1 with buckle components unlatched;

FIG. 3 is a top cross-sectional view of a portion of the apparatus of FIGS. 1 and 2 of the apparatus of FIGS. 1 and 2 illustrating one operative position of certain elements;

FIG. 4 is a top cross-sectional view of a portion of the apparatus of FIGS. 1 and 2 illustrating a different operative position of the component of FIG. 3;

DETAILED DESCRIPTION OF ILLUSTRATED EMBODIMENTS

Figure 5:
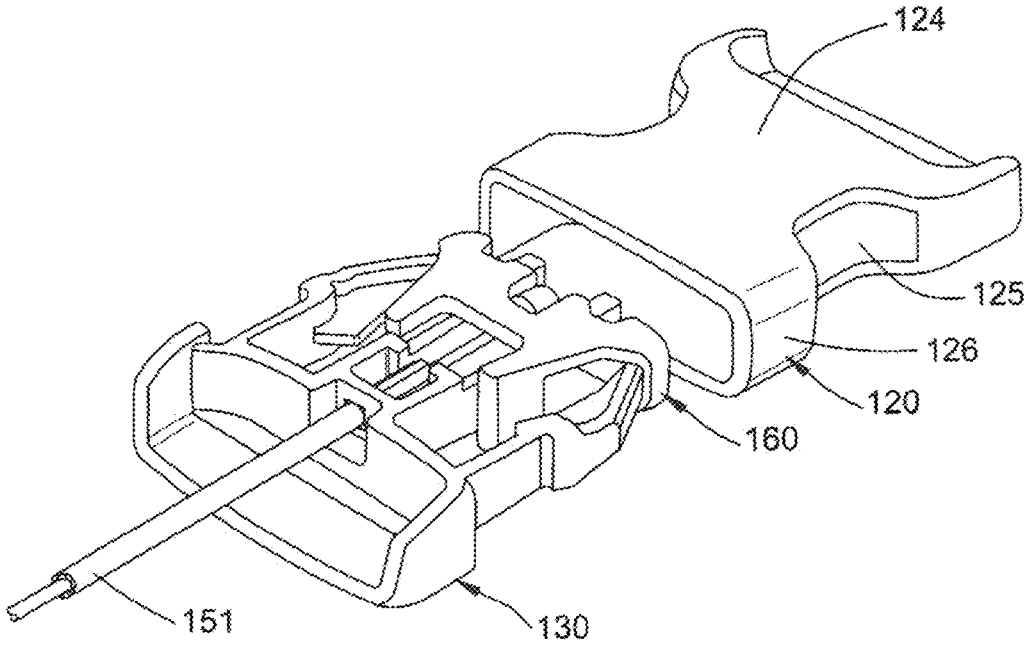
FIG. 5 is an exploded perspective view of a slide release buckle assembly illustrative of the features of the present disclosure.

Preliminary to discussion of the design of the present disclosure, a prior art remote release buckle is shown in FIGS. 1 to 4. A buckle assembly 19, consists of a hollow buckle body 20 defining a cavity with an entrance opening 22 and two side slots 23 and an insertable buckle latch 30. Side slots 23 in body 20 accommodate latching legs 34 of buckle latch 30 inserted into entrance opening 22 of buckle body 20. Side slots 23 define latching edges to releasably secure the latching legs 34 to the buckle body 20.

The inserted section of buckle latch 30 has an overall width that is greater than the width of buckle body 20 in the areas of the side slots 23, so that once buckle latch 30 is inserted through entrance opening 22 of buckle body 20, latching legs 34 snap into side slots 23 to latch buckle latch 30 into buckle body 20. The latching legs 34 each have an edge 39, that engages the latching edges at side slots 23 to prevent latching legs 34 from exiting slots 23 and inadvertently releasing buckle latch 30 from buckle body 20 under tension.

Referring to FIGS. 3 and 4 buckle latch 30 comprises a base 33, with two elongate flexible latching legs 34 extending from laterally outer ends of base 33. It also includes a central leg 35 defining a guide channel 32. Within the guide channel 32 of central leg 35 is a slidable pulling mechanism 36. Connected to mechanism 36 are two pulling arms 37 integrally formed with latching legs 34. Also connected to pulling mechanism 36 is cable 51 disposed inside a cable sleeve 52. Cable sleeve 52 surrounds cable 51 and is attached to buckle latch 30. Cable 51 is slidably movable within cable sleeve 52.

In use, pulling on cable 51 causes pulling mechanism 36 to slide toward base 33 within channel 32. This deforms arms 37, laterally toward each other pulling latching legs 34 inward, as shown in FIG. 4. This inward motion of latching legs 34 causes edges 39 of latching legs 34 to clear the latching edges of side slots 23 on main buckle body 20 to release buckle latch 30 from main buckle body 20. Optionally, the buckle latch 30 may be released from buckle body 20 by manual deformation of latching legs 34 at side slots 34.

Turning now to the advantageous configuration of the buckle assembly of the present disclosure, seen in FIGS. 5 to 14, it includes molded plastic components comprising a hollow buckle body 120, a buckle latch 130 and a separate reciprocal slide element 160. These components are illustrated separately in FIGS. 7 through 12, and shown in assembled form in various operative positions in FIGS. 5, 6, and 13 and 14.

Turning now to FIGS. 7 to 10, the buckle body 120 and buckle latch element 130 include loops for connection to webbing segments. The webbing is, in turn, connected to the associated functional construct. The illustrated buckle assembly appears as a standard side release buckle to retain user confidence and understanding. The buckle latch has the familiar function of a standard side release buckle and can be used independently of the pull cable and slide element.

In the description of the various buckle assembly components, for clarity of understanding, the terms lateral or transverse may be used, as well as the terms forward and rearward. In this context, forward means in the direction of insertion of the buckle latch into the hollow buckle body and rearward means in the opposite direction. Longitudinal means in the direction of insertion and removal of the buckle latch. Lateral, or transverse, means sideways, or perpendicular to the longitudinal forward or rearward reference.

Figure 7:
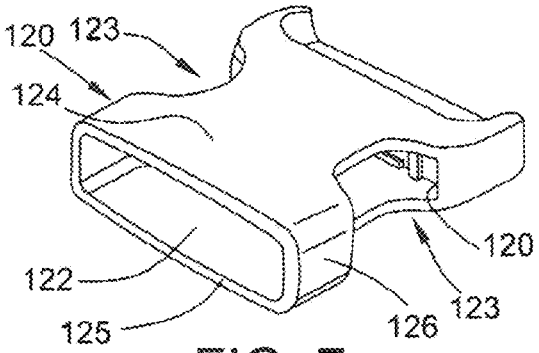
FIG. 7 is a perspective view of the buckle body of the slide release buckle assembly of FIG. 5.
Figure 8:
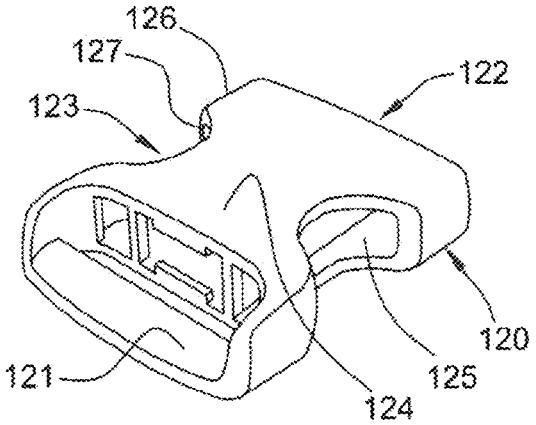
FIG. 8 is a perspective view of the buckle body of the slide release buckle assembly of FIG. 5 rotated one hundred eighty degrees (180°)

Referring to FIGS. 7 and 8, hollow main buckle body 120 includes top wall 124, bottom wall 125 and spaced lateral side walls 126, and defines a cavity with an entrance opening 122 at one end, and two side slots 123 at lateral side walls 126. Side slots 123 define a locking edge 127 on each side wall of buckle body 120.

A loop 121 is provided at an end of hollow buckle body 120 for connection to associated webbing. Although the end treatment of the buckle latch 130 and body 120 are shown as loops, other end features could also be used (e.g. ladderlocs, linear tensioners, spring sliders, split bars, etc.)

Figure 9:
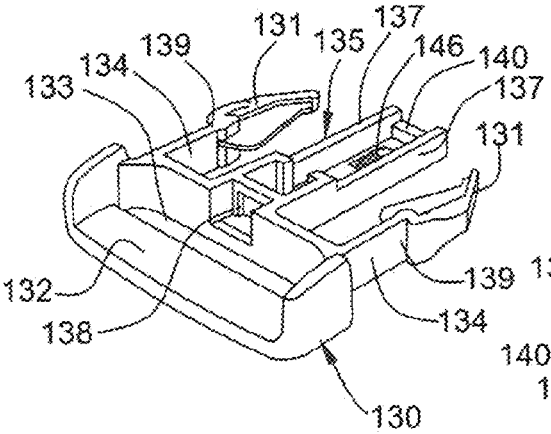
FIG. 9 is a is a perspective view of the buckle latch of the slide release buckle assembly of FIG. 5.
Figure 10:
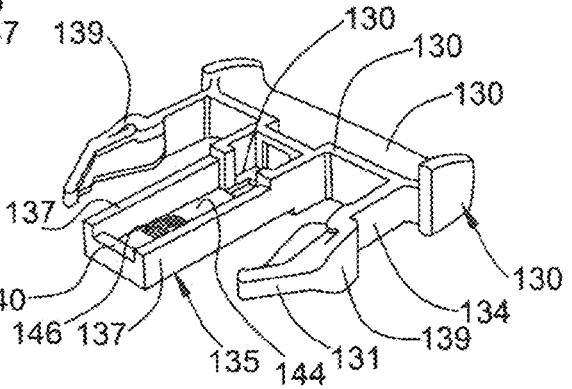
FIG. 10 is a perspective view of the buckle latch of the slide release buckle assembly of FIG. 5 rotated one hundred eighty degrees (180°)

Referring to FIGS. 9 and 10, buckle latch 130 comprises a base portion 133, with two elongate flexible legs 134 extending forward from laterally outer end of base 133. Buckle latch 130 includes a loop 132 at an end of base 133 to receive an associated webbing.

The insertable section of buckle latch 130 has an overall lateral width that is greater than the width of main buckle body 120 in the areas of the side slots 123. Latching legs 134 each have an edge latching 139, that engages a locking edge 127 on buckle body 120 to prevent latching legs 134 from exiting slots 123 and inadvertently releasing buckle latch 130 from buckle body 120 under tension. Buckle latch 130 is inserted through entrance opening 122 of buckle body 120, until latching legs 134 snap into slots 123 to achieve the locking relationship between latching edges 139 and latching edges 127.

The forward ends of latching legs 134 include side contact surfaces 131 tapered to diverge toward latching edges 139. On forward insertion of buckle latch element 130 into entrance opening 122 of buckle body 120, surfaces 131 contact the buckle body 120 to deflect the latching legs laterally toward each other. This deflection continues until the latching edges 139 surpass the latching edges 127 at side slots 123. The latching legs 134 then flex outwardly into side slots 123. The edges 139 and 127 prevent removal of latching element 130, releasably latching the buckle elements together and preventing withdrawal.

As seen in FIG. 9, buckle latch 130 also includes a central leg portion 135 which has spaced parallel guide walls 137 defining an internal cable channel 138 open at the rearward end of central leg 135. A transverse abutment wall 140 extends between guide walls 137 at the forward end of central leg 135.

A bottom wall 144 of central leg 135 extends between parallel guide walls 137. A rearward directed upstanding cantilever spring 146 is integrally molded to bottom wall 144. Spring 146 is seen in FIGS. 9 and 10, and in the cross-sectional view of FIG. 6.

For manual separation of the buckle components it is only necessary to apply pressure on the latching legs 134 at side slots 123 of buckle body 120 urging them toward each other. Once the legs 135 are sufficiently deformed laterally toward each other, latching edges 139 are closer together than latching edges 127 on main buckle body 120 and the buckle latch may be withdrawn from entrance opening 122. Notably, maximum lateral inward deformation of latching legs 139 is limited by contact of the forward or distal ends of the legs with the spaced parallel guide walls 137 of the central leg 135.

Figure 11:
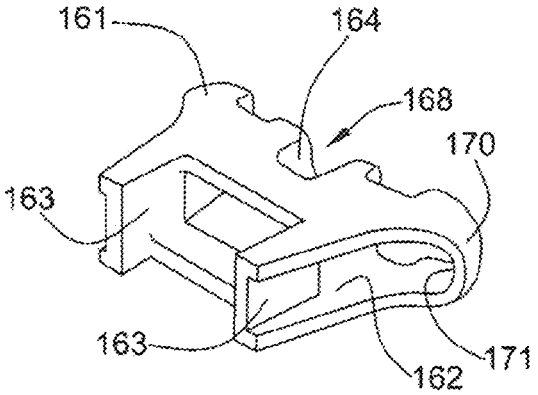
FIG. 11 is a perspective view of the buckle slide element of the slide release buckle assembly of FIG. 5.
Figure 12:
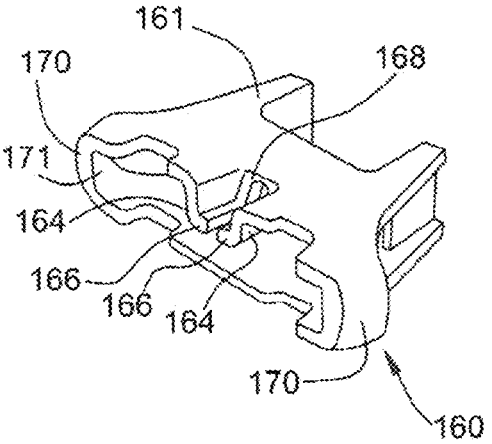
FIG. 12 is a perspective view of the buckle slide element of the slide release buckle assembly of FIG. 5 rotated one hundred eighty degrees (180°)

Referring to FIGS. 11 and 12, buckle assembly 120 further includes slide element 160. It is a separate slidable component carried by buckle latch 130. It is insertable into the hollow buckle body 120 with the buckle latch 130.

Slide element 160 includes a flat upper wall 161 and flat bottom wall 162. Slide guides 163 disposed at the rearward end of slide element 160 extend between walls 161 and 162 in sliding face-to-face relation to the laterally outer surfaces of spaced parallel guide walls 137 of central leg 135 of buckle latch element 130.

Webs 164 extend from flat top wall 161 forward of slide guides 163. Webs 164 include laterally inward directed tabs 166 that form a cable anchor pocket or well 168 best seen in FIG. 12. The webs 164 are closer together than guide walls 137 of central leg 135 and form a channel with slide guides 163 for spaced guide walls 137 of central leg 135 arranged for disposition between spaced parallel guide walls 137. This relationship provides for a smooth relative sliding relationship between slide element 160 and buckle latch element 130.

Referring to FIGS. 11 and 12, the slide element 160 includes laterally spaced cam actuators 170 extending between flat upper wall 161 and flat bottom wall 162. Cam actuators 170 define rearwardly facing divergent surfaces 171 disposed in operative relation to side contact surfaces 131 of flexible locking leg 134 of buckle latch element 130.

In the buckle assembly, slide element 160 resides upon buckle latch 130 and is reciprocable, or slidable forward and rearward with respect to the buckle latch 130. The forward ends of flexible latching legs 134 and central leg 135 are captured between flat upper wall 161 and flat bottom wall 162 with cam actuators 170 positioned forward of side contact surfaces 131 of flexible latching legs 134.

The spaced parallel guide walls 137 of central leg 135 reside in the channel defined by slide guides 163 and inner webs 164 of slide element 160. Once installed on latch element 130, the webs 164 are of sufficient length to abut transverse abutment wall 140 of central leg 135. The polymeric material of the slide element 160 is flexible, and sufficiently resilient, to deform on attachment of the slide element 160 to the latch element 130. Once attached, it returns to its unstressed shape to create the abutting relation between the forward ends of webs 164 and transverse abutment wall 140 to retain the slide element 160 on the latch element 130.

Figure 6:
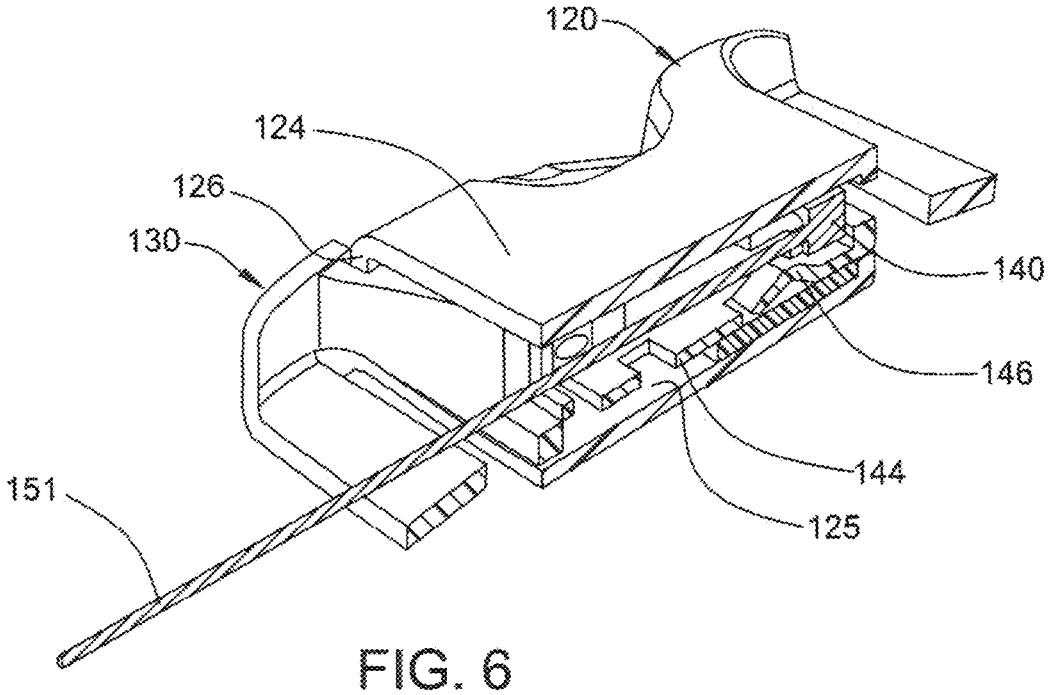
FIG. 6 is a sectional view of the buckle assembly of FIG. 5 taken along the longitudinal axis of the buckle assembly.

As best appreciated from the sectional perspective of FIG. 6, the cantilever spring 146 contacts the rearward ends of webs 164 and tabs 166 to urge slide element 160 forward relative to buckle latch 130. This relationship biases the slide element 160 forward relative to buckle latch 130 and urges the divergent surfaces 171 of cam actuators 170 forward relative to the side contact surfaces 131 of latching legs 134. Although spring 146 is a useful feature, it is considered an optional feature of the buckle assembly.

Slide element 160 is slidable, that is, it can be reciprocated relative to buckle latch element 130 between an inactive position and an active position. In the inactive position, shown in FIG. 13, cam actuators 170 are forward of side contact surfaces 131 of flexible latching legs 134 and the latching legs 134 are unstressed. That is, they are disposed in their normal position, not deformed toward each other.

Figure 14:
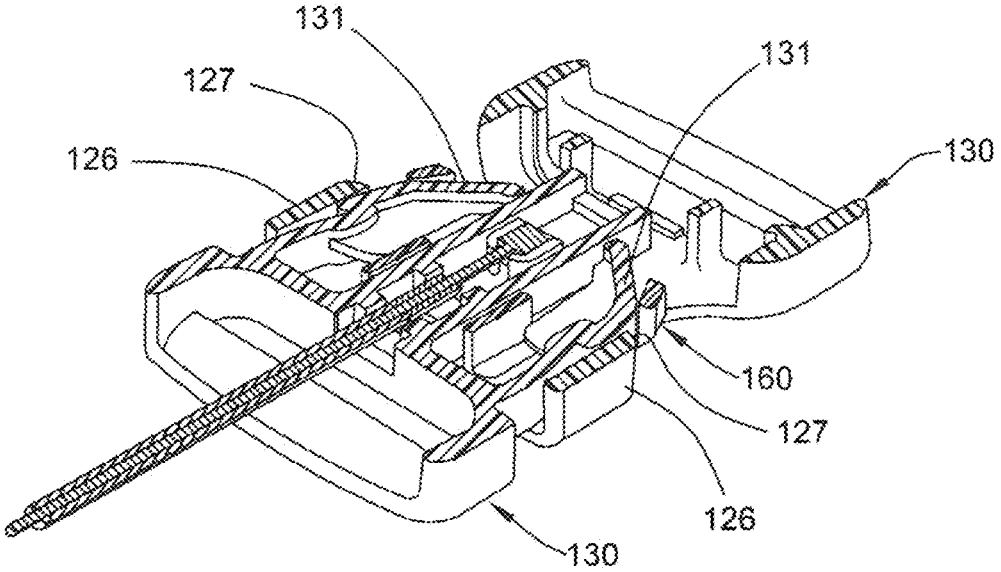
FIG. 14 is a sectional perspective view illustrative of other operative positions of components of the slide release buckle assembly of the present disclosure.

In the active position shown in FIG. 14, slide element 160 is disposed rearward relative to central leg 135. The divergent surfaces 171 of cam actuators 170 deform the latching legs 134 laterally inward such that the forward ends of latching legs 134 contact the spaced parallel guide walls 137 of central leg 135. In this deformed position, the latching edges 139 freely pass the latching edges 127 of the side slots 123 of the hollow buckle body 120.

Referring again to FIGS. 13 and 14, with the slide element 160 in its inactive position (FIG. 13), actuators 170 are forward of the side contact surfaces 131 of latching legs 134. With the slide element 160 in its rearward or active position (FIG. 14) the divergent surfaces 171 are in contact with side contact surfaces 131 of latching legs 134. The legs 134 are deformed with the forward ends of the legs in contact with the spaced parallel guide walls 137 of central leg 135. In the active position of slide element 160, flexible latching legs 134 are deflected toward each other sufficiently for latching edges 139 to freely pass latching edges 127 at side slots 123 of hollow buckle body 120. The latching legs 134 are sufficiently deflected that latching edges 139 are disengaged from latching edges 127 of hollow buckle body at side slots 123. Buckle latch 130 with slide element 160 may be withdrawn from entrance opening 140 to disengage the buckle components.

An actuator cable 151, is seen in FIGS. 5, 6, 13 and 14. It extends rearwardly through the opening at the rearward end of central leg 135. An anchor or lug 153 at the forward end of the cable 151 resides in cable anchor pocket or well 168 to connect the cable 151 to the slide element 160. Notably anchor or lug 153 is easily removable from anchor pocket 168 should repair or replacement of buckle components, including cable 151, become necessary.

Cable 151 is operable to remotely move the slide element 160 from its inactive, to its active position. A cable sleeve 154, seen in FIG. 14 may surround cable 151 and may be attached to buckle latch 130 or other fixed location. Again, while the cable sleeve is a desirable feature, it is not essential to the function of the separate slide element 160.

In use, pulling on cable 151 causes slide element 160 to slide from its inactive position, toward base 133 along central leg 135. This movement causes cam actuators 170 to deform latching legs 134 inward, as shown in FIG. 14. This inward deflection of latching legs 134 causes edges 139 of latching legs 134 to clear latching edges 127 of side slots 123 on main buckle body 120 to release buckle latch 130 from main buckle body 120.

It is contemplated that the cable 151 may be part of a multiple buckle arrangement on an article such as a protective vest. Pulling a single release ring connected to the multiple cables such as cable 151 illustrated in the drawings can be effective to simultaneously release all buckle assemblies.

Figure 13:
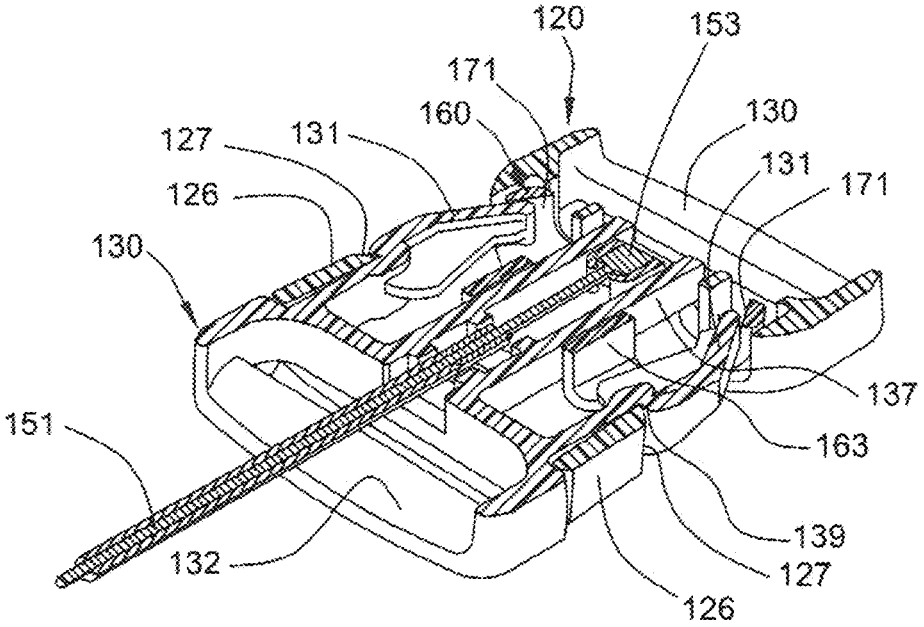
FIG. 13 is a sectional perspective view illustrative of certain operative positions of components of the slide release buckle assembly of the present disclosure.

In the images of FIGS. 13 and 14, it is shown how, in pulling cable 151, the slide 160 is actuated, releasing the buckle locking arms 134 from body 120 extracting buckle latch 130 and slide 160 from the hollow buckle body 120. The fourth or right side image of FIG. 10 shows the buckle latch 130 partially removed from the body 120. At this point, the buckle latch 130 assembly could either be removed with system geometry or with additional force on the pull cable 151. Notably, after the cable release is operated and the tension on cable 151 relieved, the locking arms 134 will return to their neutral un-stressed shape and the slide 160 will return to its inactive position.

The buckle assembly is not only usable with the cable 151. It is also usable as a standard side release buckle. As seen in FIGS. 5, 6, 13 and 14, access for manual operation is available at the side slots 123 of hollow buckle body 120. On manual deformation of the latching legs 134 toward each other, the latching edges 139 pass freely past latching edges 127 of hollow buckle body 120 at side slots 123. The buckle latch 130 with attached slide element 160 may be withdrawn from entrance opening 122.

One common complaint directed to known remote release buckle systems is the difficulty in repairing damaged components after use by the end user. The typical design requires the cable to be permanently attached to the latch for actuation. This permanent attachment complicates the removal of a damaged buckle component and re-application of a replacement.

The system described herein offers improved field reparability because of the separate slide component. The cable 151 with lug 153 is removed from the buckle assembly being replaced. The cable 151 with lug 153 is then fed through the new buckle latch 130 and slide element 160. After the lug 153 is positioned in the mating well 168, the slide element is slid onto buckle latch 130. Once the slide element 160 is fully engaged on the buckle latch 130, it will not be easily removable from buckle latch 130 because of the abutting relation between the forward ends of webs 164 and tabs 166 with transverse abutment wall 140 of central leg 135.

As mentioned, the buckle of this disclosure is a demonstration of the use of a separate slide to release the latch from the buckle body. As shown, it is possible and efficient to incorporate this design into a standard side release buckle maintaining the known and proven release mechanism but adding a secondary release mechanism with separate slide.

It is also possible to use the separate slide 160 as an actuator without maintaining the standard side release method. If the side-release functionality is not important, it is possible to use the slide 160 as a cap or provide a raised element through a slot in the upper wall of the hollow buckle body 120. The dual-release in this scenario would be pulling on the slide directly as the release or pulling on the cable 151 to release the system. Also, the buckle need not be configured as a standard side release buckle. What is important is that the separate slide element be accessible and usable as a release mechanism for the buckle system.

The incorporation of the separate slide element 160 into a buckle assembly allows for a field replaceable/field reparable solution into existing and new technologies. By utilizing the system similarly to the side release buckle as demonstrated herein, it is shown that the slide allows, and adds dual release functionality without negatively impacting the traditional side-release functionality.

While one concept for the system is disclosed, it is not the only possible application. Notably, the design presented here has applicability to buckle configurations beyond remote actuation and can be incorporated into existing and new release technologies. The incorporation of the separate slide element is particularly suitable for remote actuation of a side release buckle. However, it is also suitable to provide alternative actuation within a dual release configuration, or even in a configuration that does not involve manual side release capability. These latter alternatives require only minor modifications to the buckle assembly components.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

The invention claimed is:

1. A buckle assembly comprising:

a hollow buckle body defining an entrance opening and spaced side walls each defining a locking edge;

a buckle latch insertable into said entrance opening, including a base portion and a pair of elongated spaced deformable latching legs, each having a latching edge engageable with one of said locking edges of said buckle body, a reciprocal slide element, slidable relative to said buckle latch to unlatch said latching edges from said locking edges, wherein said buckle latch includes a central leg portion having a bottom wall and wherein said buckle latch includes a rearward directed cantilever spring in said bottom wall of said central leg portion said cantilever spring urging said slide element away from said latching edges of said latching legs of said buckle latch.

2. A buckle assembly as claimed in claim 1 wherein said elongate latching legs have an overall lateral width at said latching edges greater than the width of said buckle body between said side walls, and wherein said forward ends of said elongate latching legs each include a side contact surface that contacts one of said side walls of said buckle body at said entrance opening to deform said elongate latching legs toward each other on insertion of said latching legs into said entrance opening.

3. A buckle assembly as claimed in claim 2 wherein said side walls of said side buckle body define side slots at said locking edges and said elongate latching legs are deformed toward each other to unlatch said latching edges from said locking edges.

4. A buckle assembly as claimed in claim 3 wherein said side contact surfaces of said latching legs diverge toward said latching edges and said legs have a length sufficient to surpass said latching edges of said buckle body to permit said side contact surfaces of said latching legs to be positioned in said side slots with said latching edges of said latching legs engaged with said locking edges of said side walls of said buckle body.

5. A buckle assembly as claimed in claim 3 wherein said slide element comprises a hollow body overlying the distal ends of said elongate latching legs, and slidable toward said base portion to deform said elongate latching legs toward each other to disengage said latching edges of said latching legs from said locking edges of said side walls of said buckle body.

6. A buckle assembly as claimed in claim 5 wherein said slide element includes laterally spaced cam surfaces engageable with said side contact surfaces of said latching legs to deform said legs toward each other to disengage said latching edges from said locking edges.

7. A method of unlatching a buckle assembly as claimed in claim 6, the steps comprising:

sliding said slide assembly to cause said laterally spaced cam surfaces to engage said side surfaces of said elongate latching legs to deform said legs toward each other and disengage said latching edges from said locking edges.

8. A buckle assembly as claimed in claim 3 wherein said slide element comprises a hollow body overlying the distal ends of said elongate latching legs, slidable toward said base to deform said elongate latching legs toward each other to disengage said latching edges of said latching legs from said latching edges of said side walls of said buckle body, and wherein said slide element includes laterally spaced cam surfaces engageable with said side contact surfaces of said latching legs to deform said legs toward each other to disengage said latching edges from said locking edges.

9. A buckle assembly as claimed in claim 8 wherein said laterally spaced cam surfaces are rearwardly facing divergent surfaces engageable with said contact surfaces of said latching legs on slidable movement of said separate slide element toward said base.

10. A buckle assembly as claimed in claim 9 wherein said side contact surfaces of said latching legs diverge toward said latching edges and said legs have a length sufficient to surpass said latching edges of said buckle body to permit said side contact surfaces of said latching legs to be positioned in said side slots with said latching edges of said latching legs engaged with said locking edges of said buckle body.

11. A buckle assembly as claimed in claim 9 wherein said assembly includes a cable connected to said slide element to slide said slide element relative to said buckle latch.

12. A buckle assembly as claimed in claim 1 wherein said central leg portion defines spaced parallel guide walls and wherein said slide element includes slide guides in sliding relation to said guide walls of said central leg portion.

13. A buckle assembly as claimed in claim 3 wherein said assembly includes a cable connected to said slide element to slide said slide element relative to said buckle latch.

14. A buckle assembly as claimed in claim 1 wherein said assembly includes a cable connected to said slide element to slide said slide element relative to said buckle latch.

15. A method of unlatching a buckle assembly as claimed in claim 1, the steps comprising sliding said separate slide element to disengage said latching edges from said locking edges.

* * * * *